US007624930B2

(12) United States Patent
Honda et al.

(10) Patent No.: US 7,624,930 B2
(45) Date of Patent: Dec. 1, 2009

(54) TEMPERATURE-TYPE EXPANSION VALVE

(75) Inventors: Shin Honda, Nagoya (JP); Shigeki Ito, Okazaki (JP); Kurato Yamasaki, Anjo (JP)

(73) Assignee: Denso Corporation, Kariya (JP)

( * ) Notice: Subject to any disclaimer, the term of this patent is extended or adjusted under 35 U.S.C. 154(b) by 330 days.

(21) Appl. No.: 11/492,560

(22) Filed: Jul. 25, 2006

(65) Prior Publication Data

US 2007/0022769 A1 Feb. 1, 2007

(30) Foreign Application Priority Data

Jul. 28, 2005 (JP) ..... 2005-219353

(51) Int. Cl.
*F25D 17/06* (2006.01)

(52) U.S. Cl. ..... 236/92 B; 62/222; 62/225; 137/495

(58) Field of Classification Search ..... 62/225, 62/222; 236/92 B; 137/495
See application file for complete search history.

(56) References Cited

U.S. PATENT DOCUMENTS 6,062,484 A * 5/2000 Eybergen ..... 236/92 B
6,560,982 B2 5/2003 Kobayashi et al.

FOREIGN PATENT DOCUMENTS

| | | |
|---|---|---|
| JP | 55-133177 | 9/1980 |
| JP | 08-291954 | 11/1996 |
| JP | 2002-31-538 | 10/2002 |

* cited by examiner

*Primary Examiner*—Frantz F Jules
*Assistant Examiner*—Azim Rahim
(74) *Attorney, Agent, or Firm*—Harness, Dickey & Pierce, PLC

(57) ABSTRACT

A temperature-type expansion valve 1 includes a valve housing 110 having a first passage 121 into which a high pressure refrigerant flows, a second passage 122 through which a low pressure refrigerant flowing to an evaporator 5 flows, and a throttle passage 125 communicating the first passage 121 with the second passage 122; a valve body 130 having a valve member 131 varying a sectional area of the throttle passage 125; and an operation rod 135 for driving the valve body 130 in the interlocking arrangement with a displacement member 160 undergoing displacement in accordance with a pressure difference between a saturation pressure corresponding to an outlet temperature of the refrigerant of the evaporator 5 and an evaporation pressure of the evaporator; wherein a slide hole 124 communicating with the throttle passage 125 and accommodating the valve body 130 is formed in the valve housing 110; and the valve member 131 moves inside the slide hole 124 in the interlocking arrangement with the operation rod 135 to thereby adjust the sectional area of the throttle passage 125. Construction can be simplified and the number of components can be decreased.

13 Claims, 8 Drawing Sheets

TEMPERATURE-TYPE EXPANSION VALVE

BACKGROUND OF THE INVENTION

1. Field of the Invention

This invention relates to a temperature-type expansion valve installed to an air conditioning apparatus such as a car air conditioner, for controlling a flow rate of a refrigerant supplied to an evaporator in accordance with the temperature of the refrigerant.

2. Description of the Related Art

A temperature-type expansion valve of this kind described in Japanese Unexamined Patent Publication No. 2002-310538, for example, includes a prismatic valve housing, a first passage formed inside this valve housing for the passage of a high pressure refrigerant, a valve chamber formed inside this passage, a second passage formed inside the valve housing in parallel with the first passage, for the passage of the refrigerant sent to the evaporator side, a throttle passage into which a valve seat member for communicating the valve chamber and the second passage is pushed, a spherical valve body arranged in opposition inside the throttle passage, a third passage for the passage of the refrigerant sent from the evaporator side, and an operation rod for sensing the temperature of the refrigerant passing through the third passage and driving the valve body.

The valve seat member described above is fixed to the throttle passage under the state where it is installed in advance between the valve body and the operation rod. The operation rod has a small diameter portion inserted into the valve seat member and the spherical valve body is fixed to the distal end of the small diameter portion. In consequence, the open area of the throttle passage can be adjusted by the displacement of the valve body.

However, Japanese Unexamined Patent Publication No. 2002-310538 described above employs a complicated construction, as the flow rate regulating function, in which the rod-like operation rod, the spherical valve body, the tubular valve seat member, and so forth, are constituted integrally beforehand. Among these members, the valve seat member is fitted to the small diameter portion of the operation rod but because a gap is secured between the valve seat member and the small diameter portion, there remains the problem of centering when the valve seat member is fixed by press-fitting to the throttle passage by using the operation rod, for example.

In this construction, the valve body and the operation rod are fixed. When the operation rod is welded to the valve body, for example, a variation occurs in the length of the operation rod owing to the penetration of welding. When the valve seat member is fixed by press-fitting to the throttle passage by using such an operation rod, deformation develops at the end portion of the operation rod, so that the accuracy of the flow rate control by the expansion valve drops.

SUMMARY OF THE INVENTION

In view of the problems described above, the invention aims at providing a temperature-type expansion valve with a simple construction and few components.

To accomplish the object described above, the invention provides a temperature-type expansion valve including a valve housing (110) having a first passage (121) into which a high pressure refrigerant flows, a second passage (122) through which a low pressure refrigerant flowing to an evaporator (5) flows, a third passage (123) through which an outlet side refrigerant of the evaporator (5) flows and a throttle passage (125) communicating from the first passage (121) with the second passage (122); a valve body (130) having a valve member (131) varying a sectional area of the throttle passage (125); and an operation rod (135) for driving the valve body (130) in an interlocking arrangement with a displacement member (160) undergoing displacement in accordance with a pressure difference between a saturation pressure corresponding to an outlet temperature of the refrigerant of the evaporator (5) and an evaporation pressure of the evaporator (5); wherein a slide hole (124) communicating with the throttle passage (125) and accommodating the valve body (130) is formed in the valve housing (110) and the valve member (131) moves inside the slide hole (124) in the interlocking arrangement with the operation rod (135) to thereby adjust the sectional area of the throttle passage (125).

According to this invention, the valve body (130) is of a spool valve system reciprocating in the axial direction and, consequently, the valve mechanism including the valve body (130), the valve member (131) and the slide hole (124) can be simple. Accuracy of the flow rate control performance can be improved because fixing, such as welding or press-fitting that has been necessary in the past, is not required.

In the invention, the slide hole (124) is a hole formed from one direction of the valve housing (110), is formed in such a fashion that the valve body (130) can be fitted from one of the ends of the slide hole, and the throttle passage (125) opens in proximity to the bottom portion thereof.

According to this invention, constituent components of the valve mechanism such as the valve body (130) having the valve member (131), the operation rod (135), a later-appearing spring member (133) and later-appearing first and second seal members (136, 137) can be assembled from one direction. As the number of assembly steps can be decreased in this way, the assembly factor can be improved.

In the invention, the valve body (130) has the valve member (131) having a rod-like shape having a small diameter and a guide portion (132) having a greater diameter than the valve body. According to this invention, the valve mechanism can be constituted in a simple form. More concretely, the valve body (130) can be integrally formed by at least the guide portion (132) and the valve member (131).

Accordingly, the valve body (130) and the slide hole (124) for accommodating the valve body (130) can be easily formed by machining such as welding or push-in and the valve mechanism does not require fixing such as welding or push-in that has been necessary in the past. Therefore, the improvement of accuracy of the flow rate control performance can be achieved.

In the invention, communication ports (131*a*, 131*b*, 131*c*) as fluid passages are formed in the valve member (131), and at least one of the communication ports (131*a*, 131*b*, 131*c*) adjusts the open area of the throttle passage (125) in an interlocking arrangement with the operation rod (135).

According to this invention, at least one of the communication ports (131*a*, 131*b*, 131*c*) may well be combined with the open portion of the throttle passage (125). Therefore, a valve mechanism having a simple construction can be constituted.

In the valve mechanism of the prior art in which a spherical valve body and a tubular valve seat member are combined, the problem remains in that self-excitation vibration occurs in the valve body as the refrigerant flows in the displacing direction of the valve body. In the present invention, therefore, the flowing direction of the refrigerant flowing from the throttle passage (125) to the valve member (131) intersects at right angles the sliding direction of the valve body (130) and self-excitation vibration does not easily occur. For this reason, the occurrence of an offensive noise due to self-excitation vibration does not happen.

In the invention, at least one of the communication ports (131*a*, 131*b*, 131*c*) is open to the bottom portion of the slide hole (124). According to this invention, the pressure-reduced refrigerant flows through the bottom portion of the slide hole (124) and the low pressure after pressure reduction operates on the operation rod (135). Consequently, the driving force of the displacement member (160) for driving the operation rod (135) and the valve body (130) can be reduced, and the diameter of the displacement member (160), that is, the diameter of the diaphragm, can be decreased.

In this invention, an outer peripheral groove (131*d*) as a fluid passage is formed around the outer periphery of the valve member (131) and adjusts the open area of the throttle passage (125) in the interlocking arrangement with the operation rod (135).

According to this invention, the outer peripheral groove (131*d*) can be more easily positioned in the throttle passage (125) than in the inventions described above and the valve mechanism having a simple construction can be constituted. It is advisable to combine the outer peripheral groove (131*d*) with at least one of the communication ports (131*a*, 131*b*, 131*c*).

In this invention, the throttle passage (125) has a sectional shape such that a relation between a degree of displacement of the valve member (131) and its open area is substantially proportional. When the sectional shape of the throttle passage (125) is substantially rectangular, for example, the open area has a substantial proportional relation with the displacement amount of the valve member (131). Consequently, accuracy of the flow rate control performance can be improved.

In this invention, the valve body (130) includes a first seal member (136) for hermetically sealing a pressure difference between the third passage (123) and the second passage (122). According to this invention, the first seal member (136) can be easily arranged on the valve body (130) and can be assembled to the valve housing (110) without impeding the assembly factor of the valve body (130).

In this invention, the valve body (130) includes a second seal member (137) for hermetically sealing a pressure difference between the first passage (121) and the second passage (122). According to this invention, the second seal member (137) can be easily arranged on the valve body (130) and can be assembled to the valve housing (110) without impeding the assembly factor of the valve body (130) in the same way as the invention described above.

In this invention, a spring member (133) for energizing the displacement member (160) is arranged in such a fashion that the outlet refrigerant of the evaporator (5) has a degree of super-heat, an adjustment screw member (140) is further provided for adjusting a spring force of the spring member (133), and the spring member (133) is interposed between the valve body (130) and the adjustment screw member (140).

According to this invention, the valve body (130), the spring member (133) and the adjustment screw member (140) can be accommodated, in the order named, in the slide hole (124). Consequently, the valve body (130), the spring member (133) and the adjustment screw member (140) can be assembled from one direction and fine adjustment of the degree of super-heat can be easily made.

In this invention, a spring member (133) for energizing the displacement member (160) is arranged in such a fashion that the outlet refrigerant of the evaporator (5) has a degree of super-heat, and the spring member (133) is interposed between the valve body (130) and the slide hole (124).

According to this invention, the spring member (133) can be assembled from the same direction as the valve body (130). The size of the spring member (133) can also be reduced.

In this invention, the valve body (130) and the operation rod (135) are formed in such a fashion as to be capable of adjusting the spring force of the spring member (133). According to this invention, the length of the operation rod (135) can be adjusted by coupling the valve body (130) and the operation rod (135) by meshing, for example. Consequently, fine adjustment of the degree of super-heat can be made easily without disposing a separate adjustment mechanism.

In this invention, the displacement member (160) has a transmission member (163) for transmitting driving force to the operation rod (135), and the valve body (130) is formed integrally with the operation rod (135) or the transmission member (163) inclusive of the operation rod (135).

According to this invention, the number of components can be decreased and assembly accuracy of the connection length of the transmission member (163), the valve body (130) and the operation rod (135) can be improved. Consequently, the accuracy of the flow rate control performance can be improved because the displacement amount of the displacement member (160) can be accurately transmitted to the valve member (131).

Incidentally, reference numeral in each parenthesis represents the correspondence relation to concrete means in later-appearing embodiments.

The present invention may be more fully understood from the description of preferred embodiments of the invention, as set forth below, together with the accompanying drawings.

DESCRIPTION OF THE PREFERRED EMBODIMENTS

First Embodiment

Figure 1:
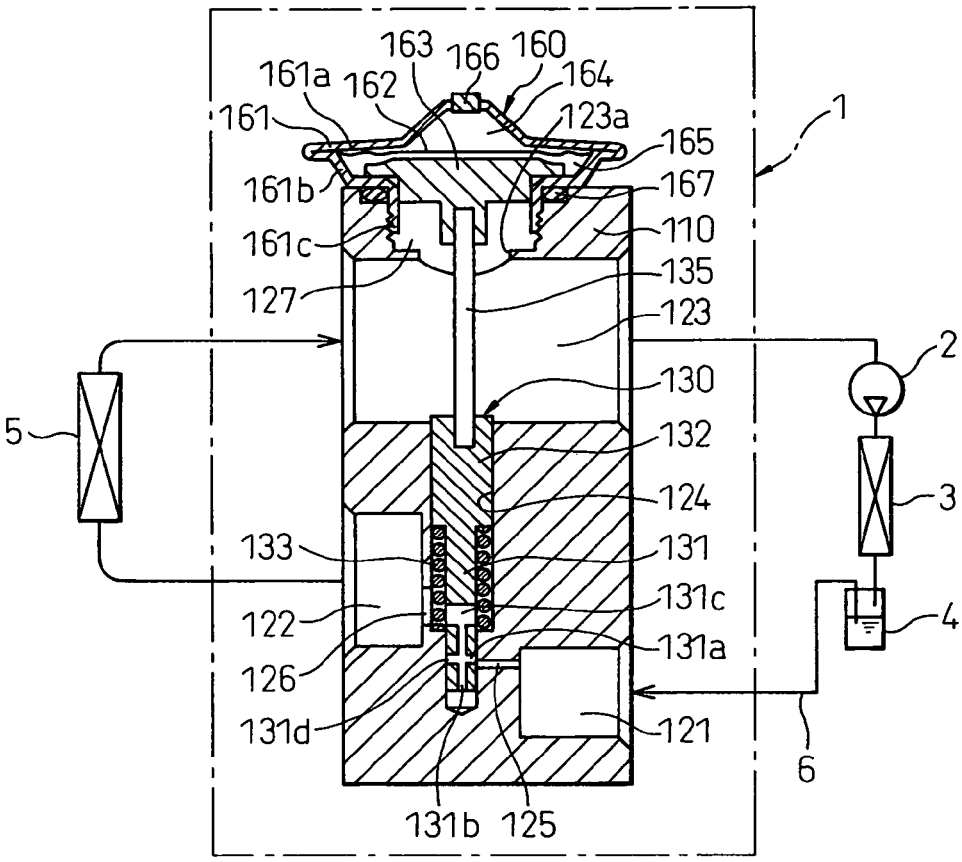
FIG. 1 is a schematic view showing an overall construction of a temperature-type expansion valve 1 according to a first embodiment of the present invention.
Figure 2:
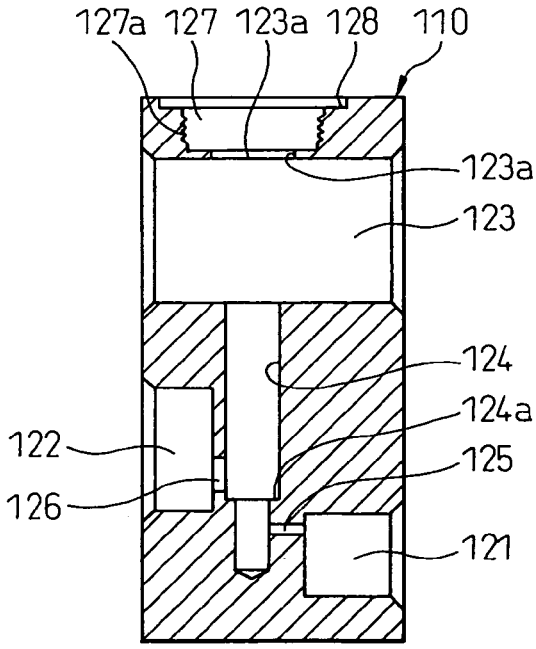
FIG. 2 is a longitudinal sectional view showing a positional relationship of a refrigerant passage formed in valve housing 110 according to the first embodiment of the invention.
Figure 3A:
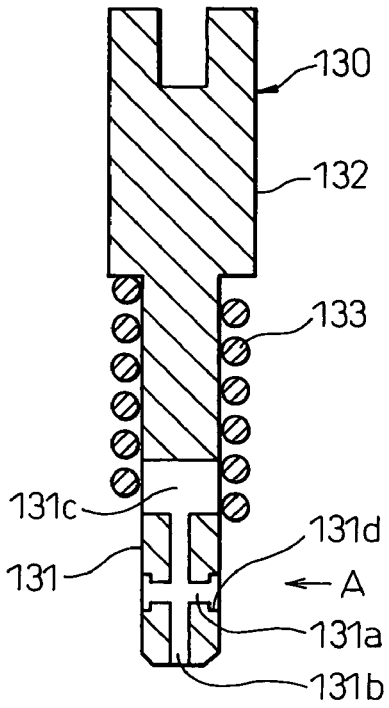
FIG. 3A is a longitudinal sectional view showing the overall construction of a valve body 130 according to the first embodiment of the invention.
Figure 3B:
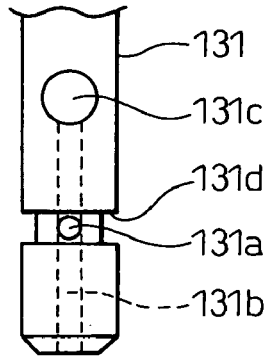
FIG. 3B is a view taken along a line A in FIG. 3A.

A temperature-type expansion valve according to the first embodiment of the invention will be hereinafter explained with reference to FIGS. 1 to 3B. FIG. 1 is a schematic view showing the overall construction of the temperature-type expansion valve and FIG. 2 is a longitudinal sectional view showing a positional relationship of a refrigerant passage formed in valve housing 110. FIG. 3A is a longitudinal sectional view showing the overall construction of valve body 130 and FIG. 3B is a view taken along a line A in FIG. 3A.

The temperature-type expansion valve 1 (hereinafter merely called "expansion valve") constitutes a known refrigeration cycle with functional components such as a compressor 2, a condenser 3, a liquid receiver 4 and an evaporator 5 as shown in FIG. 1 and these components are connected through refrigerant piping 6.

The expansion valve 1 includes a valve housing 110, a valve body 130 arranged in a refrigerant passage formed between the liquid receiver 4 and the evaporator 5, a displacement member 160 undergoing displacement in accordance with a pressure difference between a saturation pressure corresponding to an exit refrigerant temperature of the evaporator 5 and an evaporation pressure of the evaporator 5, an operation rod 135 that drives the valve body 130 in the interlocking arrangement with the displacement member 160 and a spring member 133 that urges the displacement member 160.

The valve housing 110 is housing that is formed of an aluminum alloy, for example, into a prismatic shape in such a fashion that refrigerant passages can be formed therein and the valve body 130, the displacement member 160, the operation rod 135 and the spring member 133 are arranged inside the valve housing 110.

The refrigerant passages include a first passage 121 communicating with an outlet of the liquid receiver 4, a second passage 122 communicating with an inlet of the evaporator 5, a third passage 123 one of the sides of which communicates with an outlet of the evaporator 5 and the other side of which communicates with a suction side of the compressor 2 and a throttle passage 125 and a communication passage 126 communicating the first and second passages 121 and 122 through a later-appearing slide hole 124, as shown in FIGS. 1 and 2.

The first passage 121 is a bottomed hole formed on the lower side of one of the ends of the valve housing 110 and a high pressure refrigerant flowing from the liquid receiver 4 passes through this passage and the throttle passage 125 communicating with the slide hole 124 is formed above the bottom portion. The throttle passage 125 is for reducing the pressure of the high pressure refrigerant inflowing from the first passage 121.

The second passage 122 is a bottomed hole formed above the first passage 121 at the other end of the valve housing 110. A communication passage 126 communicating with the slide hole 124 is formed at the bottom of the hole so that a low pressure refrigerant, the flow rate of which is regulated by the valve body 130, can flow.

The third passage 123 is a through-hole so formed as to penetrate through the upper portion of the valve body 130. The low pressure refrigerant evaporated by the evaporator 5 flows in from one of the ends of this hole and flows out to the compressor 2 from the other end. An open portion 123*a* is formed at an upper intermediate portion of this third passage 123. This is an open hole for transferring heat of the refrigerant flowing through the third passage 123 to the displacement member 160 arranged above the open portion 123*a*.

The slide hole 124 is formed immediately below this open portion 123*a* so that the communication passage 126 can communicate with the throttle passage 125. The slide hole 124 is shaped in such a fashion as to accommodate therein the valve body 130 and the spring member 133 and to allow the valve body 130 to reciprocate in accordance with a displacement amount of the later-appearing displacement member 160.

More concretely, the slide hole 124 is shaped in such a fashion that the outer circumference of a valve member 131 having a small diameter (to be later described) is inscribed with the slide hole 124 at a lower part while the outer circumference of a guide member 132 having a larger diameter than the valve member 131 (to be later described) is inscribed with the slide hole 124 at an upper part. A step portion 124*a* formed inside the slide hole 124 holds one of the ends of the spring member 133. Incidentally, the slide hole 124 is a bottomed and round hole one of the ends of which is open while the other end is not a through-hole.

Consequently, the refrigerant flowing into the first passage 121 flows through the throttle passage 125, the slide hole 124, the communication passage 126 and the second passage 122 in the order named inside the valve housing 110. Incidentally, reference numeral 127 denotes an open portion for arranging the displacement member 160. A screw portion 127*a* is formed at the open portion 127 and can couple with the displacement member 160 through meshing. Reference numeral 128 denotes a reception surface of a seal member 167 that hermetically seals the refrigerant flowing through the third passage 123 from outside.

Next, the displacement member 160 is a driving device for driving the valve body 130 in accordance with the displacement amount that changes with the pressure difference between the saturation pressure corresponding to the outlet temperature of the refrigerant flowing through the third passage 123 and the evaporation pressure of the evaporator 5. The displacement member 160 includes a can body 161, a diaphragm 162, a transmission member 163, etc, as shown in FIG. 1. The can body 161 has an upper lid 161*a* and a lower lid 161*b* each formed of stainless steel, and a screw portion 161*c* is formed on the lower lid 161*b*.

The diaphragm 162 and the transmission member 163 are arranged inside the can body 161. The diaphragm 162 is clamped by the upper lid 161*a* and the lower lid 161*b* around its outer peripheral portion and is fixed by welding to thereby define an upper pressure chamber 164 and a lower pressure chamber 165. The refrigerant as an operation fluid is charged into the upper pressure chamber 164 and is sealed by a plug 166.

The transmission member 163 is formed of aluminum or stainless steel and its outer peripheral portion is supported by the lower lid 161*b*. Its upper surface keeps contact with diaphragm 162 while its lower surface is exposed inside the open portion 12. In other words, the evaporation pressure of the refrigerant flowing through the third passage 123 acts on the lower surface of the transmission member 163.

On the other hand, the temperature of the refrigerant flowing through the third passage 123 is transferred to the upper pressure chamber 164 through the can body 161, the transmission member 163 and the diaphragm 162. Consequently, the saturation pressure corresponding to the temperature of the refrigerant as the operation fluid that is heat-transferred inside the upper pressure chamber 164 operates on the diaphragm 162.

Therefore, the saturation pressure corresponding to the outlet temperature of the refrigerant flowing through the third passage 123 operates on the diaphragm 162 in the upper pressure chamber 164 and the evaporation pressure of the evaporator 5 operates on the diaphragm 162 in the lower pressure chamber 165. In other words, the diaphragm 162 undergoes displacement owing to the pressure difference between the saturation pressure of the upper pressure chamber 164 and the evaporation pressure of the lower pressure chamber 165, and the transmission member 163 undergoes displacement, too, in the interlocking arrangement with the diaphragm 162.

The operation rod 135 meshes with the lower part of the transmission member 163 and the other end of this operation rod 135 is fitted into the valve body 130. The operation rod 135 is a shaft having a small diameter and formed of stainless steel and drives the valve body 130 in the interlocking arrangement with the displacement of the transmission member 163.

Next, the construction of the valve body 130 will be explained with reference to FIGS. 1 and 3A. The valve body 130 is formed of stainless steel, is shaped substantially into a cylindrical shape and is accommodated in such a fashion as to be inscribed with the slide hole 124. The valve body 130 can reciprocate inside the slide hole 124 in its axial direction.

The valve body 130 has a valve member 131 having circular cylinder surfaces as partition portions at upper and lower parts thereof and communication ports 131*a* to 131*c* for forming a valve flow passages at the center. The valve flow passage provides a valve whose communication area is variable in cooperation with the opening to the slide hole 124 of the throttle passage 125.

The communication area of the valve flow passage with the valve body 130 changes depending on the position of the valve body 130 in the axial direction. In other words, the sectional area of the throttle passage 125 formed in the valve housing 110 can be adjusted as the valve body 130 moves in the slide hole 124.

More concretely, the valve body 130 in this embodiment is constituted by the valve member 131 having a small diameter and the guide portion 132 having a large diameter at the lower part of the valve body 130 as shown in FIGS. 3A and 3B and can be assembled when inserted from the open end of the slide hole 124 under the state where the spring member 133 is assembled.

The portion of the valve body 130 inside the slide hole 124 has a shape such that the outer diameter is constant, or decreases, from the open end of the slide hole 124 towards the closed end. The portion of the valve body 130 inside the slide hole 124 is shaped in such a fashion that its diameter becomes small either gradually or step-wise. This construction makes it possible to conduct one-directional assembly.

The valve member 131 having a small diameter has a plurality of communication ports 131*a* to 131*c* and an outer peripheral groove 131*d*. More concretely, the communication port 131*a* is so shaped as to communicate with the throttle passage 125. The communication port 131*c* is so shaped as to communicate with the communication passage 126. The communication port 131*b* is so shaped as to extend from the lower end of the valve member 131 in the axial direction of the valve body 130 so that the communication port 131*a* communicates with the communication port 131*c*. The outer peripheral groove 131*d* is formed round the outer periphery of the open end of the communication port 131*a*.

Incidentally, the communication ports 131*a* and 131*b* are so formed as to possess small diameters in the same way as the throttle passage 125, and the communication port 131*c* is so shaped as to possess a greater diameter. The outer peripheral groove 131*d* formed round the outer periphery of the communication port 131*a* is so shaped as to be capable of varying the open area of the throttle passage 125 opening to the slide hole 124.

In other words, the open area of the throttle passage 125 increases when the valve body 130 moves downward in the slide hole 124. That is, the groove is shaped in such a fashion that the greater the displacement amount of the valve body 130, the greater becomes the degree of opening (valve opening) of the throttle passage 125. Therefore, the flow rate of the refrigerant passing through the outer peripheral groove 131*d* and the communication port 131*a* increases when the displacement amount is great.

After passing through the communication port 131*a*, the coolant flows through the communication port 131*b*, the communication port 131*c*, the communication passage 126 and the second passage 122 in the order named. The refrigerant pressure that is reduced by the throttle passage 125 and the communication port 131*a* operates on the bottom portion of the slide hole 124 because the communication port 131*b* opens.

The spring member 133 in this embodiment is fitted in such a fashion that its spring force energizes the operation rod 135 towards the displacement member 160 so that the outlet refrigerant from the evaporator has a degree of super-heat. More concretely, the spring force operates on the valve body 130 as the spring member 133 is accommodated between the valve body 130 and the slide hole 124.

More concretely, the spring member 133 is constituted by a coil-shaped spring having a diameter equal to, or a little smaller than, the guide portion 132 and is assembled to the outer periphery above the valve member 131 in such a fashion that one of its ends is arranged at the step portion 124*a* of the slide hole 124 and the other is arranged at the upper end of the valve member 131. Consequently, the spring force of the spring member 133 can operate on and urge the displacement member 160 through the operation rod 135. Therefore, the transmission member 163 is urged upward by the spring force of the spring member 133.

Here, the production method of the expansion valve 1 having the construction described above will be explained. First of all, a cutting process of each refrigerant passage, slide hole 124, open portions 123*a*, 127, etc formed in the valve housing 110 can be made from one direction as shown in FIG. 2. Particularly, boring can be made from the side of the upper open portions 123*a*, 127 in the case of the slide hole 124.

In the case of the throttle passage 125 and the communication passage 126, too, boring can be conducted from the side of the first passage 121 or the second passage 122. In the valve body 130, on the other hand, each communication hole 131*a* to 131*c* and outer peripheral groove 131*d* can be easily formed as shown in FIG. 3B.

When the valve body 130 is assembled to the valve housing 110, one of the ends of the operation rod 135 is fitted in advance into one of the ends of the guide portion 132. In this way, the spring member 133 and the valve body 130 can be accommodated in the slide hole 124 from one direction.

The displacement member 160 can be arranged into the valve housing 110 when the seal member 167 is assembled to the reception surface 128 and is meshed with the displacement member 160. Incidentally, to assemble the displacement member 160, meshing is achieved while one of the ends of the operation rod 135 is engaged with one of the ends of the transmission member 163. According to this assembly method, the valve body 130, the spring member 133, the operation rod 135 and the displacement member 160 can be assembled from one direction.

Next, the operation of the expansion valve 1 of this embodiment will be explained. The liquid refrigerant flowing from the liquid receiver 4 passes through the throttle passage 125 from the first passage 121 and adiabatically expands and changes to a mist-like refrigerant when it passes through the gap (outer peripheral groove 131*d*) between the valve member 131 and the slide hole 124 and through the communication holes 131*a* and 131*b*. The refrigerant then flows out to the evaporator 5 through the communication hole 131*c*, the communication passage 126 and the second passage 122.

On the other hand, the refrigerant evaporated by the evaporator 4 flows into the third passage 123 and is sucked into the suction side of the compressor 2. Here, the flow rate of the refrigerant flowing into the second passage 122 from the first passage 121 through the outer peripheral groove 131*d* and the communication ports 131*a* and 131*b* is decided by the degree of opening of the throttle passage 125 by the valve member 131, that is to say, by the valve opening.

In other words, the valve body 130 keeps its balance position at the position where the saturation pressure inside the upper pressure chamber 164, that acts in the direction in which the transmission member 163 is biased downward in the drawing, balances with the evaporation pressure of the evaporator 4, that acts in the direction in which the transmission member 163 is biased upward in the drawing, plus the spring force of the spring member 133.

The degree of super-heat of the evaporator 5 rises when the temperature inside the passenger compartment rises and vigorous evaporation occurs in the evaporator 5, for example. Consequently, the refrigerant outlet temperature rises and the saturation pressure of the upper pressure chamber 164 rises. As a result, the transmission member 163 is pushed down in the drawing and the valve body 130 moves down together with the operation rod 135, thereby increasing the valve opening. In consequence, the flow rate of the refrigerant flowing out to the evaporator 5 increases.

When the temperature inside the passenger compartment drops and the degree of super-heat of the evaporator 5 becomes low, the transmission member 163 is moved up contrary to the operation described above. As the valve body 130 moves up together with the operation rod 135, thereby degreasing the valve opening, the flow rate of the refrigerant flowing to the evaporator 5 decreases.

Incidentally, the system in which the valve body 130 is allowed to reciprocate in the vertical direction in the drawing owing to the displacement of the displacement member 160 and thereby varies the valve opening is generally called a "spool valve system". According to this spool valve system, the valve member 131 can be advantageously formed in a simple construction and in a small diameter.

According to the expansion valve 1 of the first embodiment described above, the slide hole 124 for accommodating the valve body 130, that communicates with the throttle passage 125 is formed in the valve housing 110 and the sectional area of the throttle passage 125 can be adjusted as the valve member 131 moves inside the slide hole 124 in an interlocking arrangement with the operation rod 135.

In consequence, because the spool valve system in which the valve body 130 is allowed to reciprocate in the axial direction is employed, the valve mechanism including the valve body 130, the valve member 131 and the slide hole 124 can be formed in a simple construction. The accuracy of the flow rate control performance can be improved because fixing by welding or push-in is not necessary, for the spherical valve mechanism, as has been necessary in the past.

The slide hole 124 is a bottomed hole formed from one direction of the valve housing 110 and the valve body 130 can be inserted from its open end. Therefore, the constituent components of the valve mechanism such as the valve body 130 having the valve member 131, the operation rod 135 and the spring member 133 can be assembled from one direction. Consequently, the number of assembly steps can be reduced and the assembly factor can be improved.

Further, because the valve body 130 has the rod-like valve member 131 having a small diameter and the guide portion 132 having a greater diameter than the valve member 131, the valve mechanism can be formed in a simple form. More concretely, the valve body 130 can be formed integrally by at least the guide portion 132 and the valve member 131.

Because the valve body 130 and the slide hole 124 for accommodating the valve body 130 can be easily formed by machining such as cutting, the accuracy of the flow rate control performance can be improved without the necessity for fixing means of the valve mechanism, such as welding and push-in, a has been necessary in the past.

By the way, the outer peripheral groove 131*d* is formed around the outer periphery of the valve member 131 and adjusts the open area of the throttle passage 125 in the interlocking arrangement with the operation rod 135. The valve mechanism can thus be formed in a simple construction because the outer peripheral groove 131*d* may well be combined with the open portion of the throttle passage 125.

In the valve mechanism of the prior art in which the spherical valve body is combined with the tubular valve seat member, a problem of the occurrence of self-excitation vibration of the valve body exists because the refrigerant flows in the displacement direction of the valve body. In the present invention, therefore, the flowing direction of the refrigerant from the throttle passage 125 to the valve member 131 intersects at right angles the sliding direction of the valve body 130 and self-excitation vibration does not easily occur. Consequently, an offensive noise resulting from self-excitation vibration does not occur.

At least one of the communication ports 131*a*, 131*b* and 131*c* formed in the valve member 131 is open to the bottom portion of the slide hole 124. Therefore, as the reduced-pressure refrigerant passes through the bottom portion of the slide hole 124, the low pressure, after pressure reduction, is applied to the operation rod 135.

As a result, the driving force of the displacement member 160 for driving the operation rod 135 and the valve body 130 can be decreased and the diameter of the displacement member 160, that is, the diameter of the diaphragm, can be decreased.

The spring member 133 can be assembled from the same direction as the valve body 130 because the spring member 133 for biasing the displacement member 160 is interposed in the gap between the spring member 133 and the valve body 130. The size of the spring member 133 can be reduced.

Second Embodiment

In this embodiment, the relation between the degree of displacement and the open area is determined when the sectional shape of the outer peripheral groove 131*d* or the communication port 131*a* for changing the sectional area of the throttle passage 125 is changed. Concretely, according to the experiments carried out by the present inventors, the relation between the degree of displacement and the open area becomes substantially proportional when the outer peripheral groove 131*d* is formed, and the accuracy of flow rate control can be improved.

Figure 4A:
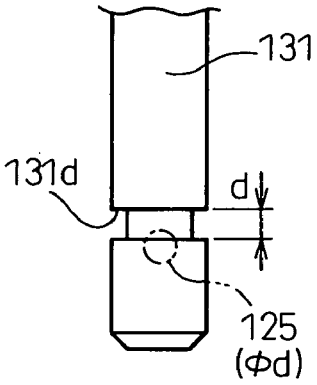
FIGS. 4A to 4C are schematic views showing a shape of each of a valve member 110 and a throttle passage in a second embodiment of the present invention.
Figure 4B:
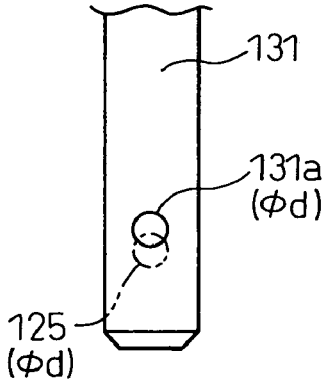
Figure 4C:
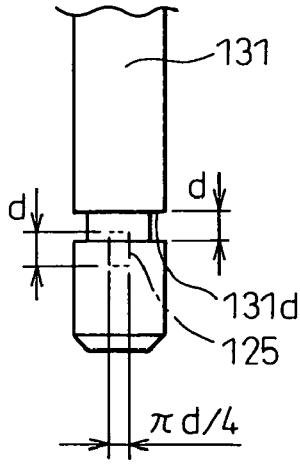
Figure 5:
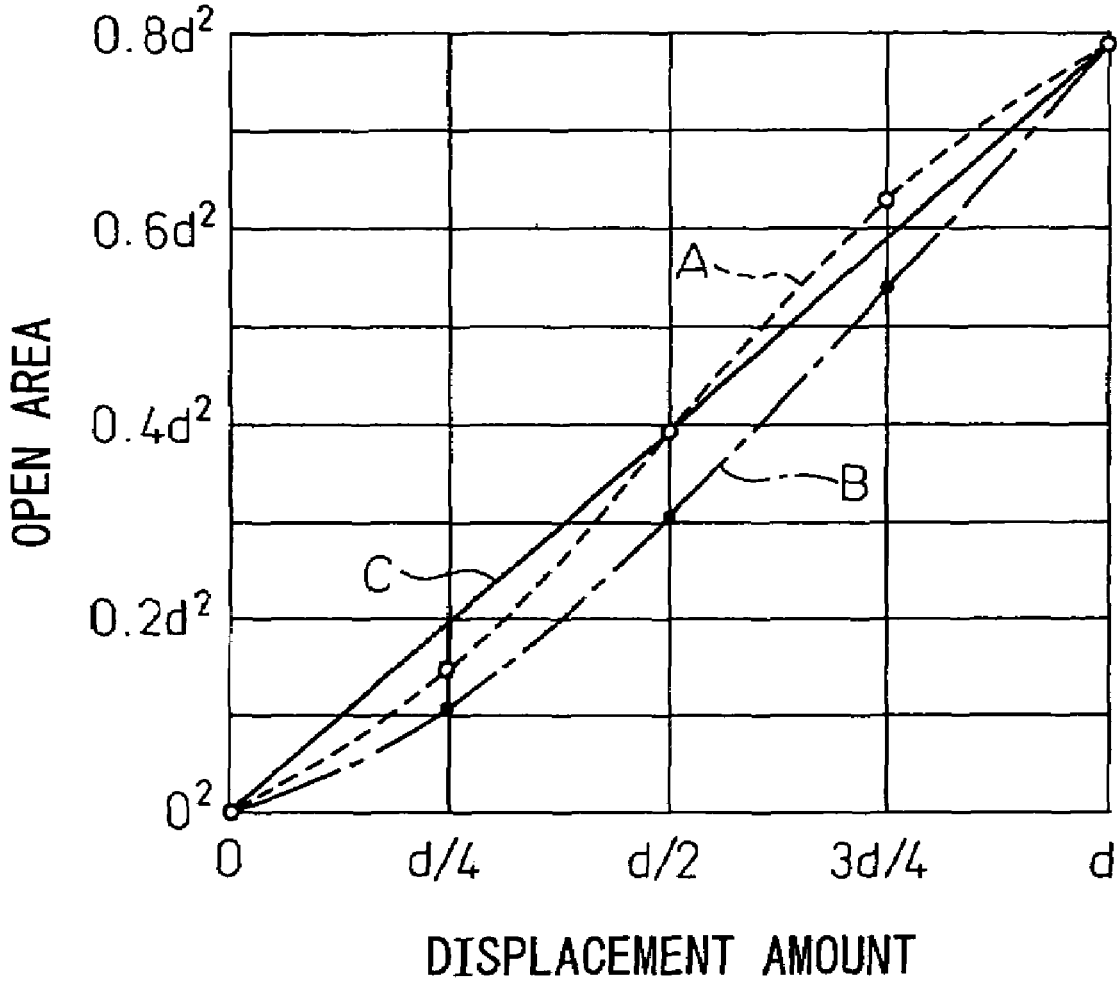
FIG. 5 is a graph showing the relation between a displacement amount and an open area when the shape of the shapes of the valve member 110 and throttle passage are used as parameters.

An explanation will be given with reference to FIGS. 4A to 4C and FIG. 5. FIGS. 4A to 4C are schematic views showing the shape of the outer peripheral groove 131*d* or the communication port 131*a* formed in the throttle passage 125 and the valve member 131. FIG. 5 is a graph showing the relation of the degree of displacement and the open area when the shapes shown in FIGS. 4A to 4C are used as the parameters.

In FIG. 4A, the throttle passage 125 is formed into a round hole having a diameter ϕd. The width of the outer peripheral groove 131*d* is d that is also a diameter of the round hole of the throttle passage 125. In FIG. 4B, the throttle passage 125 is formed into a round hole having a diameter of ϕd and the same communication port 131*a* as in the round hole of the throttle passage 125 is formed in the valve member 131.

In FIG. 4C, the throttle passage 125 is formed into a rectangular hole of d×πd/4 and the width of the outer peripheral groove 131*d* of the valve member 131 is the same as d of FIG. 4A. The relation between the degree of displacement and the open area depending on these shapes is compared with reference to FIG. 5.

Referring to FIG. 5, symbol A represents the performance of the shape shown in FIG. 4A, B represents the performance of the shape shown in FIGS. 4B and C represents the performance of the shape shown in FIG. 4C. The shape shown in FIG. 4C is most preferred.

By the way, the performance shown by A in the graph has substantially a proportional relation and exhibits practically sufficient performance. The performance of B in the graph is off from the proportional relation but the production of the shape is easy in this case. In the case of this shape, however, assembly accuracy is required for positioning the respective holes. It is advisable to form the guide portion 132 of the valve body 130 into a rectangular shape, for example.

It can be understood from the second embodiment described above that positioning to the throttle passage 125 becomes easier and a valve mechanism having a more simplified construction can be formed by forming the outer peripheral groove 131*d* in the valve member 131. The throttle passage 125 has a sectional shape that makes the relation between the degree of displacement of the valve member 131 and the open area substantially proportional. Therefore, when the throttle passage 125 has a rectangular shape, for example, the open area has substantially a proportional relation with the degree of displacement of the valve member 131. Consequently, improvement of accuracy of the flow rate control performance can be achieved.

Third Embodiment

In the foregoing embodiments, the valve body 130 is shaped into a substantially cylindrical shape and the slide hole 124 is formed in such a fashion that the valve member 131 of the valve body 130 and the outer periphery of the guide portion 132 are inscribed with one another and the valve body 130 is accommodated in the slide hole 124. However, this construction is not restrictive. For example, a seal member for hermetically sealing the gap between the valve body and the slide hole 124 may also be arranged.

Figure 6:
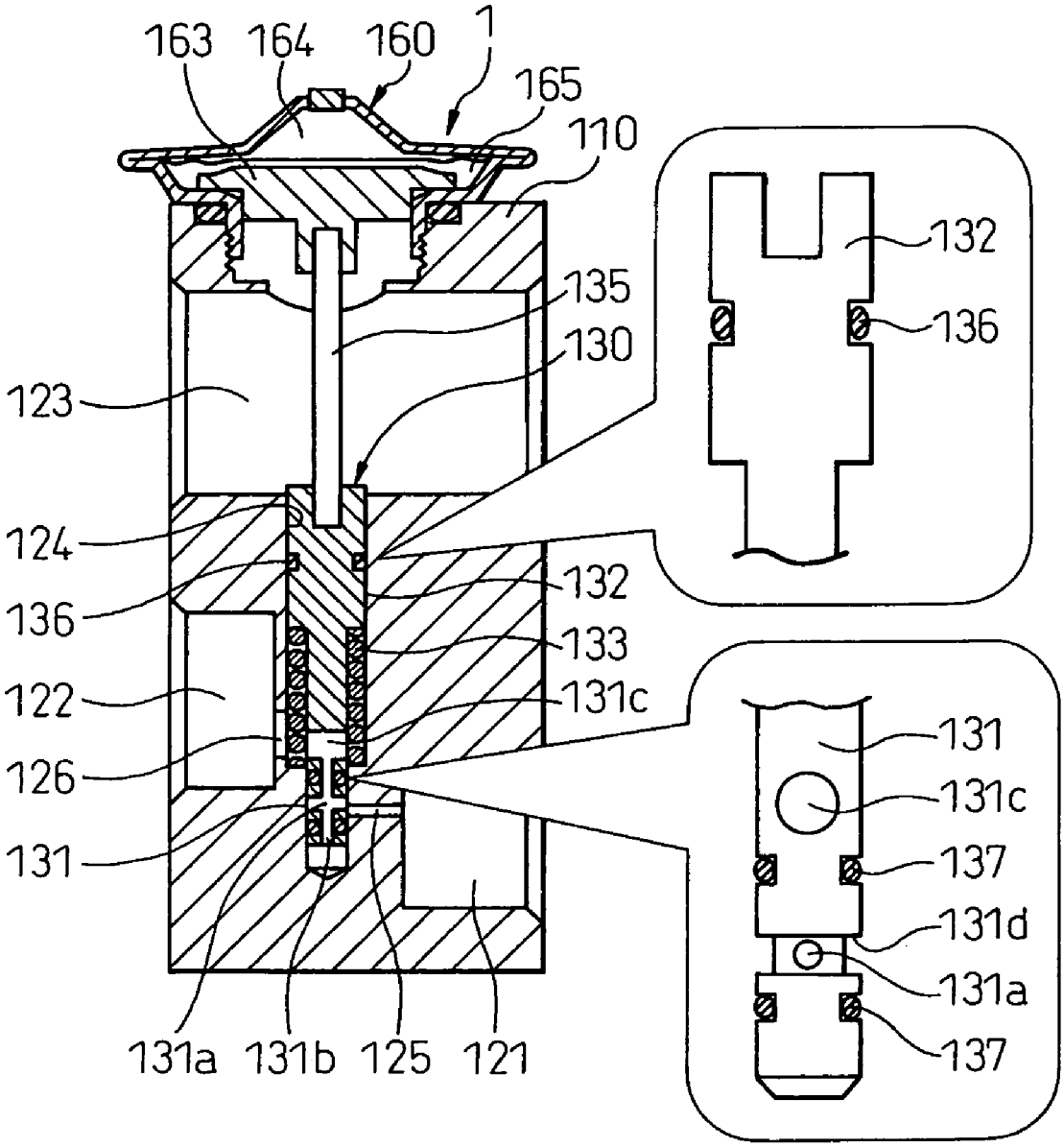
FIG. 6 is a schematic view showing an overall construction of a temperature-type expansion valve 1 according to a third embodiment of the present invention.

Concretely, as shown in FIG. 6, to hermetically seal the pressure difference between the third passage 123 and the second passage 122, that is, the pressure difference between the inlet refrigerant and the outlet refrigerant of the evaporator 4, a recessed groove is formed in the outer periphery of the guide portion 132 an a first seal member 136 such as an O-ring is fitted into the groove.

To seal the pressure difference between the first passage 121 and the second passage 122, that is, the difference of height on the refrigeration cycle, a recessed groove is formed round the outer periphery of the valve member 131 and a second seal member 137 such as an O-ring may well be fitted into the groove.

According to this construction, the first and second seal members 136 and 137 can be easily arranged to the valve body 130 and the valve housing 110 can be assembled without impeding the assembly factor of the valve body 130.

Fourth Embodiment

Figure 7:
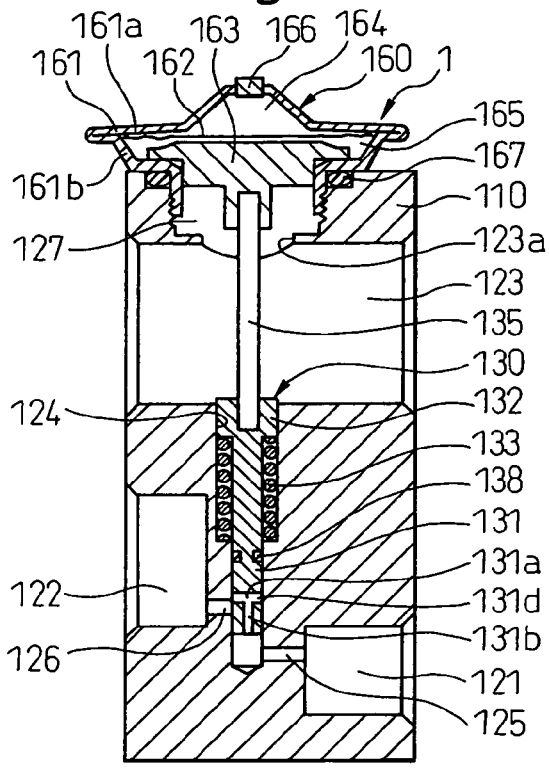
FIG. 7 is a schematic view showing an overall construction of a temperature-type expansion valve 1 according to a fourth embodiment of the present invention.
Figure 8:
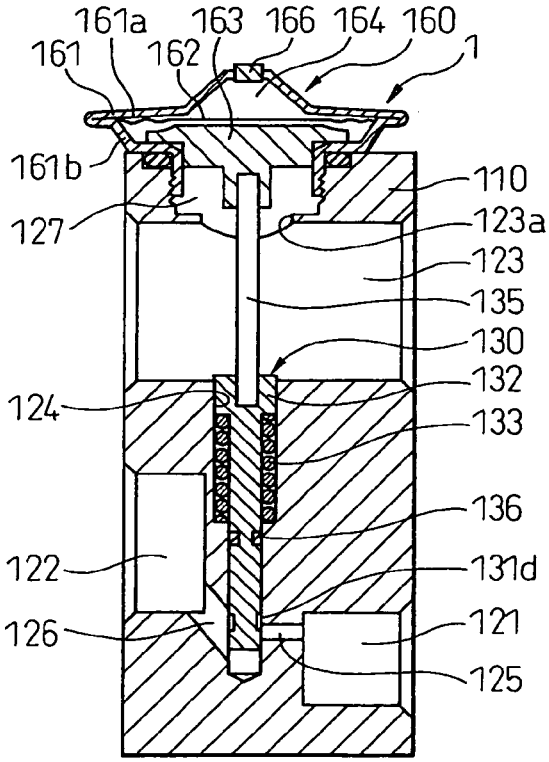
FIG. 8 is a schematic view showing an overall construction of a temperature-type expansion valve 1 according to a fifth embodiment of the present invention.

In the foregoing embodiments, the open area of the throttle passage 125 connected to the first passage 121 is adjusted by the outer peripheral groove 131*d* formed on the valve member 131 but it is also possible to employ the following construction. Namely, the open area of the throttle passage 125 connected to the second passage 122 may be adjusted by the outer peripheral groove 131*d* formed on the valve member 131, more concretely as shown in FIG. 7.

In this case, however, a communication passage 126 is formed between the first passage 121 and the slide hole 124 and the throttle passage 125 is formed between the second passage 122 and the slide hole 124. Two communication ports 131*a* and 131*b* are formed in the valve member 131.

According to the construction described above, the high pressure refrigerant flowing into the first passage 121 flows into the bottom portion of the slide hole 124 through the communication passage 126 and then through the communication port 131*b* and the communication port 131*a* in this order. Therefore, in this case, too, the refrigerant is subjected to adiabatic expansion in the communication port 131*b*, the communication port 131*a* and the throttle passage 125, and after its flow rate is adjusted in the outer peripheral groove 131*d* and the throttle passage 125, the refrigerant flows through the throttle passage 125 and the second passage 122.

Consequently, the refrigerant, the pressure of which is reduced and the flow rate of which is adjusted, flows to the evaporator 5. However, the high pressure acts on the operation rod 135 at the bottom portion of the slide hole 124. In other words, in this embodiment, the degree of displacement of the displacement member 160 requires a saturation pressure higher than the pressure applied to the operation rod 135, and the diameter of the displacement member 160, that is, the diameter of the diaphragm, must be increased.

Because the pressure difference occurs at this time between the third passage and the bottom portion of the slide hole 124, a third seal member 138 is preferably disposed round the outer periphery of the valve body 130 to establish air-tightness.

Fifth Embodiment

In the foregoing embodiments, the valve body 131 having the outer peripheral groove 131*d* around the outer periphery of the communication port 131*a* is formed but only the outer peripheral groove 131*d* may be formed on the valve member 131 without forming the communication port 131*a*.

In this case, a slant hole inclining obliquely downward from the second passage 122 may be formed in the communication passage 126 formed between the second passage 122 and the slide hole 124. According to this construction, the refrigerant, after pressure reduction, passes through the bottom portion of the slide hole 124 and the low pressure after the pressure reduction acts on the operation rod 35 in the same way as in the first to third embodiments.

Sixth Embodiment

Figure 9:
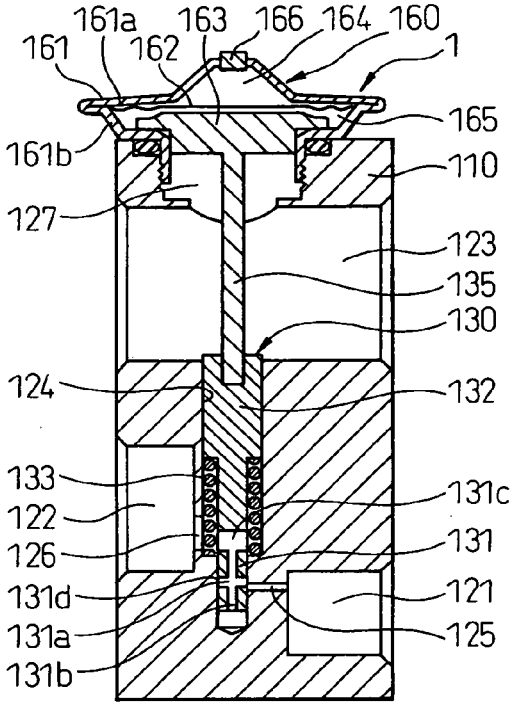
FIG. 9 is a schematic view showing an overall construction of a temperature-type expansion valve 1 according to a sixth embodiment of the present invention.

In the foregoing embodiments, the transmission member 163, the operation rod 135 and the valve body 130 are formed into separate members and are then meshed or fitted to one another for assembly but they may be formed integrally. Concretely, the operation rod 135 and the transmission member 163 may be formed integrally as shown in FIG. 9.

Figure 10:
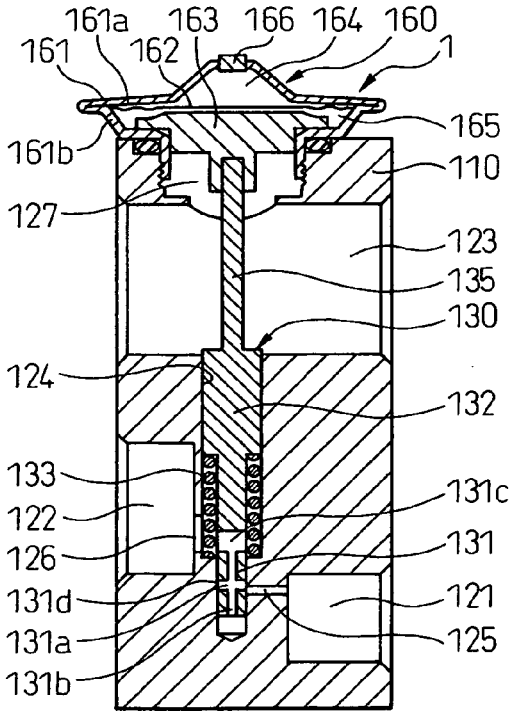
FIG. 10 is a schematic view showing an overall construction of a temperature-type expansion valve 1 according to the sixth embodiment of the present invention.
Figure 11:
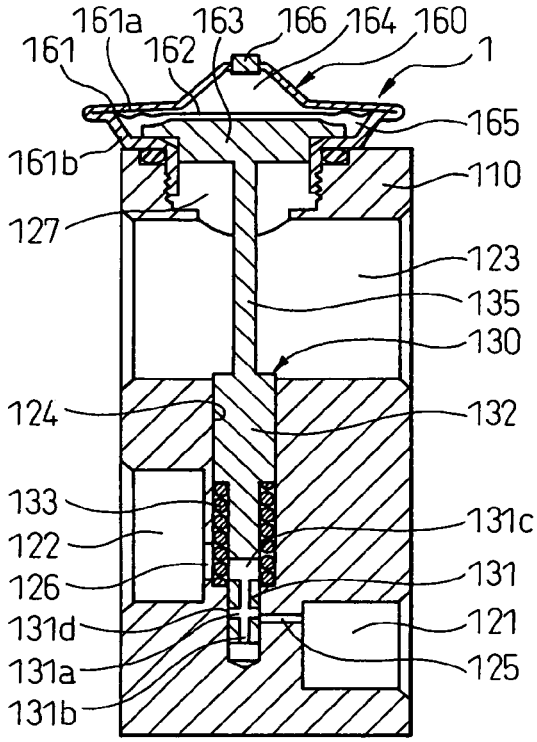
FIG. 11 is a schematic view showing an overall construction of a temperature-type expansion valve 1 according to the sixth embodiment of the present invention.

The valve body 130 and the operation rod 135 are formed integrally with each other as shown in FIG. 10. Further, the valve body 130, the operation rod 135 and the transmission member 163 are formed integrally with one another as shown in FIG. 11. According to this construction, the number of components can be decreased and the respective constituent components are integrally formed without being assembled by insertion, etc. As a result, assembly accuracy of the connection length of the transmission member 163, the valve body 130 and the operation rod 135 can be improved. Because the degree of displacement of the displacement member 160 can be transmitted accurately to the valve body 131, the accuracy of the flow rate control performance can be improved.

Seventh Embodiment

The foregoing embodiments employ the construction in which the operation rod 135 is fitted into one of the ends of the valve body 130 for assembly or the construction in which the operation rod 135 and the valve body 130 are integrally formed. However, the construction is not particularly limited thereto but an adjustment function by meshing may also be used so as to change the length of the operation rod 135.

Figure 12:
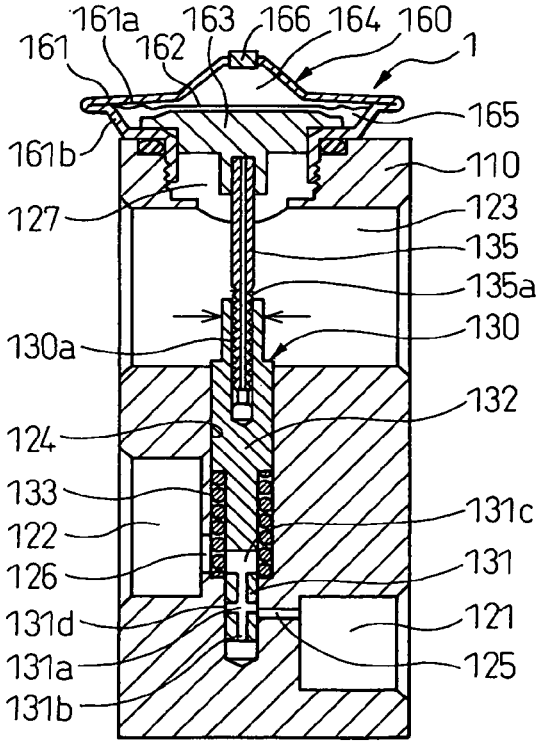
FIG. 12 is a schematic view showing an overall construction of a temperature-type expansion valve 1 according to a seventh embodiment of the present invention.

Concretely, a bottomed insertion hole 130*a* having a female screw portion is formed at one of the ends of the guide portion 132 of the valve body 132 and a male screw portion 135*a* meshing with the insertion hole 130*a* is formed in the operation rod 135 as shown in FIG. 12.

When the valve body 130 is assembled to the valve housing 110, one of the ends of the operation rod 135 is, in advance, screwed into the insertion hole 130*a* of the guide portion 132. The spring member 133 is inserted from the open end of the slide hole 124 under the state where it is put into the outer periphery of the valve member 131. In this way, spring member 133 and the valve body 130 can be accommodated into the slide hole 124 from one direction.

While the seal member 167 is assembled to the reception surface 128, the other end of the operation rod 135 is assembled into the transmission member 163 and the displacement member 160 is meshed, so that the displacement member 160 can be provided to the valve housing 110.

Next, the operation rod 135 is rotated from the right and left open portions of the third passage 123 to change its meshing depth. The length of the operation rod 135 can thus be adjusted. In other words, fine adjustment of the degree of super-heat, inclusive of the spring force of the spring member 133, becomes possible by adjusting the length of the operation rod 135.

At this time, loosening of the screw portion after adjustment can be prevented by forming the operation-rod 135 by a hollow shaft and coupling the guide portion 132 by caulking in the direction indicated by arrow in the drawing. The expansion valve 1 having this construction can easily and finely adjust the degree of super-heat without disposing a separate adjustment mechanism.

In other words, fine adjustment of the degree of super-heat becomes possible without increasing the number of components and loosening after adjustment can be prevented. The guide portion 132 is coupled by caulking after the adjustment of the length but a fixing agent for fixing the mutual screw portions may also be applied.

Eighth Embodiment

In the seventh embodiment described above, the operation rod 135 and the valve body 130 are interconnected by coupling to finely adjust the degree of super-heat. Besides this construction, a separate member to operate as an adjustment screw mechanism may be disposed.

Figure 13:
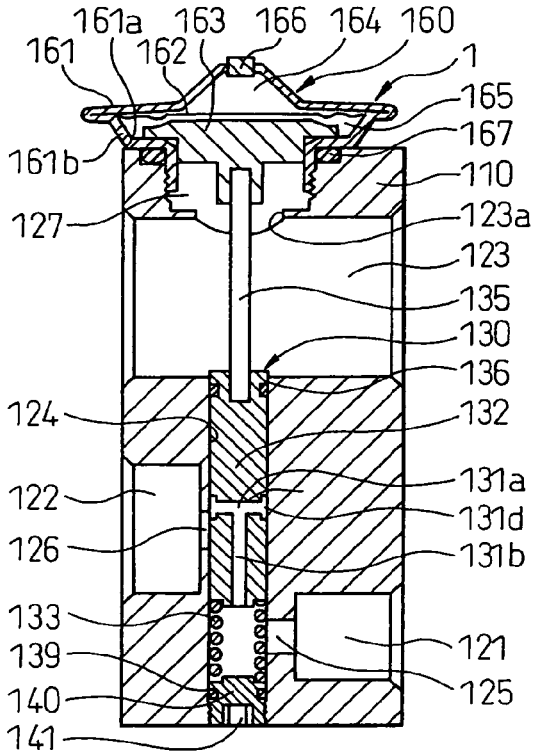
FIG. 13 is a schematic view showing an overall construction of a temperature-type expansion valve 1 according to an eighth embodiment of the present invention.

Concretely, the valve body 130 and the valve housing 110 are shaped so that an adjustment screw member 140, as an adjustment mechanism, can be provided at the bottom portion of the slide hole 124 as shown in FIG. 13 and the spring member 133 can be arranged between this adjustment screw member 140 and the lower end of the valve body 130. The adjustment screw member 140 is so shaped as to receive, on the upper surface thereof, one of the ends of the spring member 133. A groove is formed at the upper part of the outer periphery while a screw portion is formed at the lower part. A fourth seal member 139 such as an O-ring is disposed in the outer peripheral groove to cut off communication of the bottom portion of the slide hole 124 from the outside.

Further, a hexagonal hole 141 is formed at the bottom of the adjustment screw member 140 and the screw member 140 is screwed into the screw portion of the slide hole 124 by using a tool such as a wrench. The slide hole 124 is formed in such a manner as to possess the screw portion at the bottom in the valve housing 110.

The valve body 130 has at its valve member 131 the outer peripheral groove 131*d* and the communication ports 131*a* and 131*b* so as to adjust the open area of the throttle passage 125 connected to the second passage 122 in the same way as in the fourth embodiment. The other end of the spring member keeps contact with the lower end of the valve member 131.

According to the construction described above, the spring force of the spring member 133 can bias the displacement member 160 through the valve body 130 and the operation rod 135, and fine adjustment of the degree of super-heat can be made by the adjustment screw member 140. In this embodiment, the adjustment screw member 140 is first screwed from the open end side and then the spring member 130 and the valve member 130 are inserted. In this way, assembly from one direction can be made.

Other Embodiments

Figure 14:
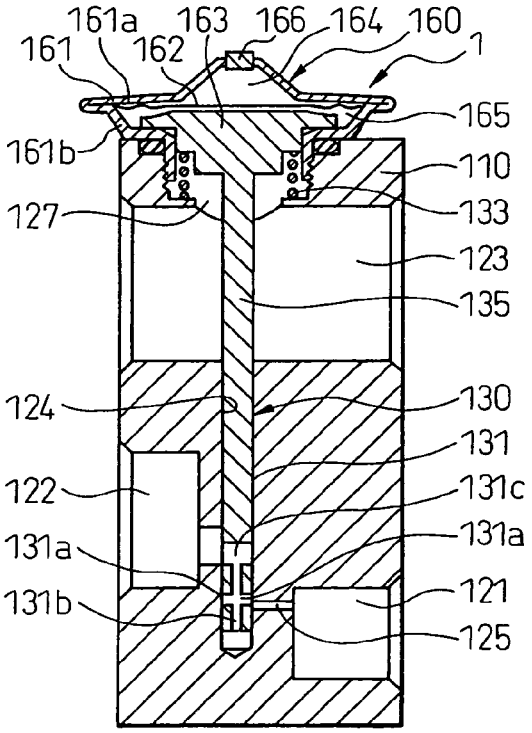
FIG. 14 is a schematic view showing an overall construction of a temperature-type expansion valve 1 according to still another embodiment of the present invention.

In the foregoing embodiments, the spring member 133 is accommodated with the valve body 130 in the slide hole 124 but this construction is not restrictive. Namely, the spring member 133 may be arranged inside the open portion 127 below the displacement member 160 as shown in FIG. 14.

In other words, one of the ends of the spring member 133 is arranged at the lower end of the open portion 127 formed in the valve housing 110 and the other end is arranged at the lower end of the transmission member 163. Consequently, the spring force of the spring member 133 is biased to the displacement member 160. In this case, the guide portion 132 having a large diameter need not be formed in the valve body 130. The slide hole 124 and the valve body 130 can be formed in a simple shape.

While the invention has been described by reference to specific embodiments chosen for purposes of illustration, it should be apparent that numerous modifications could be made thereto by those skilled in the art without departing from the basic concept and scope of the invention.

The invention claimed is:

1. A temperature-type expansion valve comprising:

a valve housing having a first passage into which a high pressure refrigerant flows, a second passage through which a low pressure refrigerant flowing to an evaporator flows, a third passage through which a refrigerant on the outlet side of said evaporator flows, and a throttle passage communicating with said first passage;

a valve body having a communication port facing said throttle passage; and an operation rod for driving said valve body in an interlocking arrangement with a displacement member undergoing displacement in accordance with a pressure difference between a saturation pressure corresponding to an outlet temperature of the refrigerant flowing through said third passage and an evaporation pressure of said evaporator;

wherein a slide hole communicating with said throttle passage and accommodating said valve body is formed in said valve housing; and said valve body moves inside said slide hole in the interlocking arrangement with said operation rod to thereby adjust an overlapped sectional area of said throttle passage and said communication port.

2. A temperature-type expansion valve according to claim 1, wherein said slide hole, as a hole formed from one direction of said valve housing, is formed in such a fashion that said valve body can be fitted from one of the ends of said slide hole and said throttle passage opens in proximity with the bottom portion thereof.

3. A temperature-type expansion valve according to claim 1, wherein said valve body has a valve member having a rod-like shape having a small diameter and a guide portion having a greater diameter than said valve member.

4. A temperature-type expansion valve according to claim 1, wherein said communication port formed in said valve body adjusts an open area of said throttle passage in the interlocking arrangement with said operation rod.

5. A temperature-type expansion valve according to claim 1, wherein a second communication port is open to the bottom portion of said slide hole.

6. A temperature-type expansion valve according to claim 1, wherein an outer peripheral groove communicating with said communication port is formed around the outer periphery of said valve body and adjusts the open area of said throttle passage in the interlocking arrangement with said operation rod.

7. A temperature-type expansion valve according to claim 4, wherein said throttle passage has a sectional shape such that a relation between a degree of displacement of said valve body and its open area is substantially proportional.

8. A temperature-type expansion valve according to claim 1, wherein said valve body includes a first seal member for hermetically sealing a pressure difference between said third passage and said second passage.

9. A temperature-type expansion valve according to claim 1, wherein said valve body includes a second seal member for hermetically sealing a pressure difference between said first passage and said second passage.

10. A temperature-type expansion valve according to claim 1, which further comprises a spring member for energizing said displacement member, arranged in such a fashion that the outlet refrigerant of said evaporator has a degree of superheat, and an adjustment screw member for adjusting a spring force of said spring member, and wherein said spring member is interposed between said valve body and said adjustment screw member.

11. A temperature-type expansion valve according to claim 1, which further comprises a spring member, for energizing said displacement member, arranged in such a fashion that the outlet refrigerant of said evaporator has a degree of superheat, and wherein said spring member is interposed between said valve body and said slide hole.

12. A temperature-type expansion valve according to claim 11, wherein said valve body and said operation rod are formed in such a fashion as to be capable of adjusting the spring force of said spring member.

13. A temperature-type expansion valve according to claim 1, wherein said displacement member has a transmission member for transmitting driving force to said operation rod, and said valve body is formed integrally with said operation rod or said transmission member inclusive of said operation rod.

* * * * *

UNITED STATES PATENT AND TRADEMARK OFFICE

CERTIFICATE OF CORRECTION

PATENT NO. : 7,624,930 B2
APPLICATION NO. : 11/492560
DATED : December 1, 2009
INVENTOR(S) : Honda et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 454 days.

Signed and Sealed this

Twenty-sixth Day of October, 2010

David J. Kappos

David J. Kappos
*Director of the United States Patent and Trademark Office*